US009433984B2

(12) United States Patent
Braidt et al.

(10) Patent No.: US 9,433,984 B2
(45) Date of Patent: *Sep. 6, 2016

(54) METHOD AND DEVICE FOR LUBRICATING THE CYLINDERS OF A ROLL STAND

(71) Applicant: SIEMENS VAI METALS TECHNOLOGIES GMBH, Linz (AT)

(72) Inventors: Thomas Braidt, Linz (AT); Reinhard Karl, Klosterneuburg (AT); Christian Lehner, Gramastetten (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/377,451

(22) PCT Filed: Feb. 7, 2013

(86) PCT No.: PCT/EP2013/052359

§ 371 (c)(1),
(2) Date: Aug. 7, 2014

(87) PCT Pub. No.: WO2013/120749

PCT Pub. Date: Aug. 22, 2013

(65) Prior Publication Data

US 2015/0013419 A1 Jan. 15, 2015

(30) Foreign Application Priority Data

Feb. 15, 2012 (EP) ..... 12155480

(51) Int. Cl.
*B21B 27/10* (2006.01)
*B21B 45/02* (2006.01)

(52) U.S. Cl.
CPC ..... *B21B 27/10* (2013.01); *B21B 45/0251* (2013.01)

(58) Field of Classification Search
CPC ..... B21B 27/06; B21B 27/10; B21B 37/32; B21B 45/02; B21B 45/0251
See application file for complete search history.

(56) References Cited

U.S. PATENT DOCUMENTS 5,090,225 A * 2/1992 Schimion ..... 72/45
8,297,099 B2 10/2012 Seidel (Continued)

FOREIGN PATENT DOCUMENTS

CN 1537035 10/2004
CN 201211528 3/2009

(Continued)

OTHER PUBLICATIONS

International Search Report May 13, 2013 issued in corresponding International patent application No. PCT/EP2013/052359.

(Continued)

*Primary Examiner* — Teresa M Ekiert
(74) *Attorney, Agent, or Firm* — Ostrolenk Faber LLP

(57) ABSTRACT

A method for lubricating the cylinders of a roll stand, for roll nip lubrication in a roll stand for a roll band. A mixture of water and oil is produced by a mixing and spraying device, which is supplied with water by a first supply line (3) and is supplied with oil by a second supply line (2). The mixture is sprayed to the strip and/or into the roll nip and/or to at least one of the cylinders of the roll stand. The water flowing to the mixing and spraying device (10) is heated by a heating device (6) provided in the first supply line (3) for a predetermined period of time set by controlling a control unit (9).

20 Claims, 2 Drawing Sheets

(56) References Cited

U.S. PATENT DOCUMENTS

| | | | | |
|---|---|---|---|---|
| 8,720,244 | B2 | 5/2014 | Takahama et al. | |
| 2004/0217184 | A1 | 11/2004 | Seidel | 239/8 |
| 2011/0094829 | A1* | 4/2011 | Seidel | B21B 27/10 184/6.4 |

FOREIGN PATENT DOCUMENTS

| | | | |
|---|---|---|---|
| DE | 10 2007 042 898 | A1 | 12/2008 |
| EP | 0 367 967 | | 5/1990 |
| EP | 1 829 625 | A1 | 9/2007 |
| EP | 2 040 860 | B1 | 5/2011 |
| JP | 8-215717 | | 8/1996 |
| JP | 8-224612 | | 9/1996 |

OTHER PUBLICATIONS

International Preliminary Report on Patentability dated May 9, 2014 issued in corresponding International patent application No. PCT/EP2013/052359.

Chinese Office Action dated Apr. 23, 2015 issued in Chinese Application No. 201380009675.6 (with an English translation).

* cited by examiner

METHOD AND DEVICE FOR LUBRICATING THE CYLINDERS OF A ROLL STAND

CROSS-REFERENCE TO RELATED APPLICATIONS

The present application is a 35 U.S.C. §§371 national phase conversion of PCT/EP2013/052359, filed Feb. 7, 2013, which claims priority of European Patent Application No. 12155480.2, filed Feb. 15, 2012, the contents of which are incorporated by reference herein. The PCT International Application was published in the German language.

TECHNICAL FIELD

The invention relates to a method and a device for lubricating the cylinders of a roll stand, in particular for roll nip lubrication in a roll stand for a roll band. A mixture of water and oil is produced by means of a mixing and spraying device. The device is supplied with water by a first supply line and is supplied with oil by a second supply line. The mixture is sprayed onto the strip being rolled and/or into the roll nip and/or onto at least one of the cylinders of the roll stand.

PRIOR ART

It is known that for the production of rolling stock, its surface quality can be improved if the friction coefficient between the cylinders and the rolling stock is reduced. By introducing a lubricant during the production of a roll band, for example, not only is the energy to be expended for the rolling process reduced, but the service life of the cylinders of a roll stand is also increased. Usually oil and water are mixed into an emulsion in a mixer. By means of connecting lines, which may be one or more meters in length, this emulsion is supplied to an arrangement of nozzles which spray the emulsion onto the strip being rolled and/or into the roll nip and/or onto the cylinders.

After a certain operating time, however, the effect of the roll nip lubrication decreases as saponification occurs both in the mixing unit and in the nozzles and also in the connecting lines. That deposit reduces the active flow area. If a saponification particle detaches from the internal wall of a pipe or of the mixer and is washed into the outlets of a nozzle, the nozzle may become blocked. In this area, the roll nip lubrication then fails completely.

To solve the problem of saponification and the associated reduction in the effect of the lubrication, maintenance work for the roll nip lubrication is necessary. In such maintenance, the mixer, the pipes between the mixer and nozzle, and the nozzles themselves are flushed with hot water, if necessary with the addition of one or more chemical cleaning agents, or are blasted to clear them.

Such roll nip lubrication is known, for example, from EP 2 040 860 B 1. Hot water is added to the oil or water supply line, or to the mixing unit itself, by means of a third supply line. During maintenance of roll nip lubrication, the rolling process is interrupted. The heated water is kept ready in a thermally insulated hot water tank. The provision of the hot water, as well as the supply by means of a third thermally insulated line, is associated with corresponding technical effort.

SUMMARY OF THE INVENTION

It is an object of the present invention to provide a method and a device for lubricating the cylinders of a roll stand. The constructed as simply as possible and its maintenance affects the availability of a rolling mill as little as possible.

This object is achieved for a method and for a device with the features of the invention.

According to a fundamental idea of the invention, the hot water used for cleaning purposes is produced by a heating device, which heats the water flowing into the water supply line, heating it virtually in line. This heating device is permanently installed but is only active for a time interval which is predetermined by a control device. As a result, a third supply line which supplies hot water to the mixing unit or to connecting lines between the mixing unit and nozzle is unnecessary. The constant provision of hot water is likewise unnecessary. The expense of a thermally insulated container for the provision of warm or hot water is spared as a result. This has several advantages. On the one hand, a system for roll nip lubrication can be easily constructed. On the other hand, cleaning of the roll nip lubrication system can be performed more easily. During a short maintenance downtime, the hot water for flushing the mixing unit and nozzles is also available very quickly and its temperature can be adjusted to requirements very easily. This also enables cleaning during short production downtimes so that saponification can be countered at an early stage. Energy can be supplied to the heating device in various ways, for example electrically or using another fuel, e.g. gas or oil.

In a preferred embodiment, the heating device can be operated electrically, e.g. as an instantaneous water heater. An instantaneous water heater has several advantages. On the one hand, the necessary construction volume for a rolling mill compared with a hot water cylinder is much smaller. The water temperature necessary for cleaning can be very precisely predetermined and adjusted by means of electronic control of the energy supply to the individual resistance heating elements. As a result, the energy requirements can be adjusted to the level of the contamination of the lubrication equipment.

It may be favorable if the control unit for determining the time interval in which cleaning takes place uses a process variable from cylinder lubrication, for example a measurement signal in the water supply, which indicates the level of contamination of the mixing and spraying device. Such a measurement signal may, for example, be obtained by means of a sensor which is arranged in the water supply. The sensor may be a pressure sensor or a flow sensor.

For efficient cleaning, it may be advantageous if the control unit controls the heating device in such a way that the water flowing to the mixing and spraying device is heated to a predetermined temperature of more than 60° C. and is adjusted to this temperature.

Saponification of the emulsion can be reduced by means of a permanent water treatment plant installed in the water supply, e.g. an ion exchanger or osmosis plant. In addition, soft water is favorable for an instantaneous electric water heater as there is less calcification on the heating elements.

In a particularly preferred embodiment provision can be made for the mixing and spraying device to be comprised of a number of nozzle-mixer-units, wherein each nozzle-mixer-unit is supplied with both water and oil separately. In contrast to the prior art, where a mixing device supplies several nozzles, in the present embodiment of the invention, a separate mixing unit is assigned to each nozzle. The design of each nozzle-mixer-unit is structurally compact as a unit and includes both the mixing function and the spraying function. As a result, there are virtually no connecting lines between the mixer and the nozzle in which saponification could occur. The dwell time of the emulsion/dispersion in the unit is very short, resulting in reduced saponification. As a result, the rolling process need not be interrupted as often as with prior art for the purposes of cleaning the roll nip lubrication.

Maintenance work can be made easier if each of these nozzle-mixer-units can be released from its fixture device by means of a quick release fastener e.g. a bayonet fastening. By this means contaminated units can be changed very quickly during maintenance downtime.

BRIEF DESCRIPTION OF THE DRAWINGS

For further explanation of the invention, in the following section of the description reference will be made to drawings from which additional advantageous embodiments, details and developments of the invention based on a non-restrictive exemplary embodiment can be taken. These drawings show.

EMBODIMENT OF THE INVENTION

Figure 1:
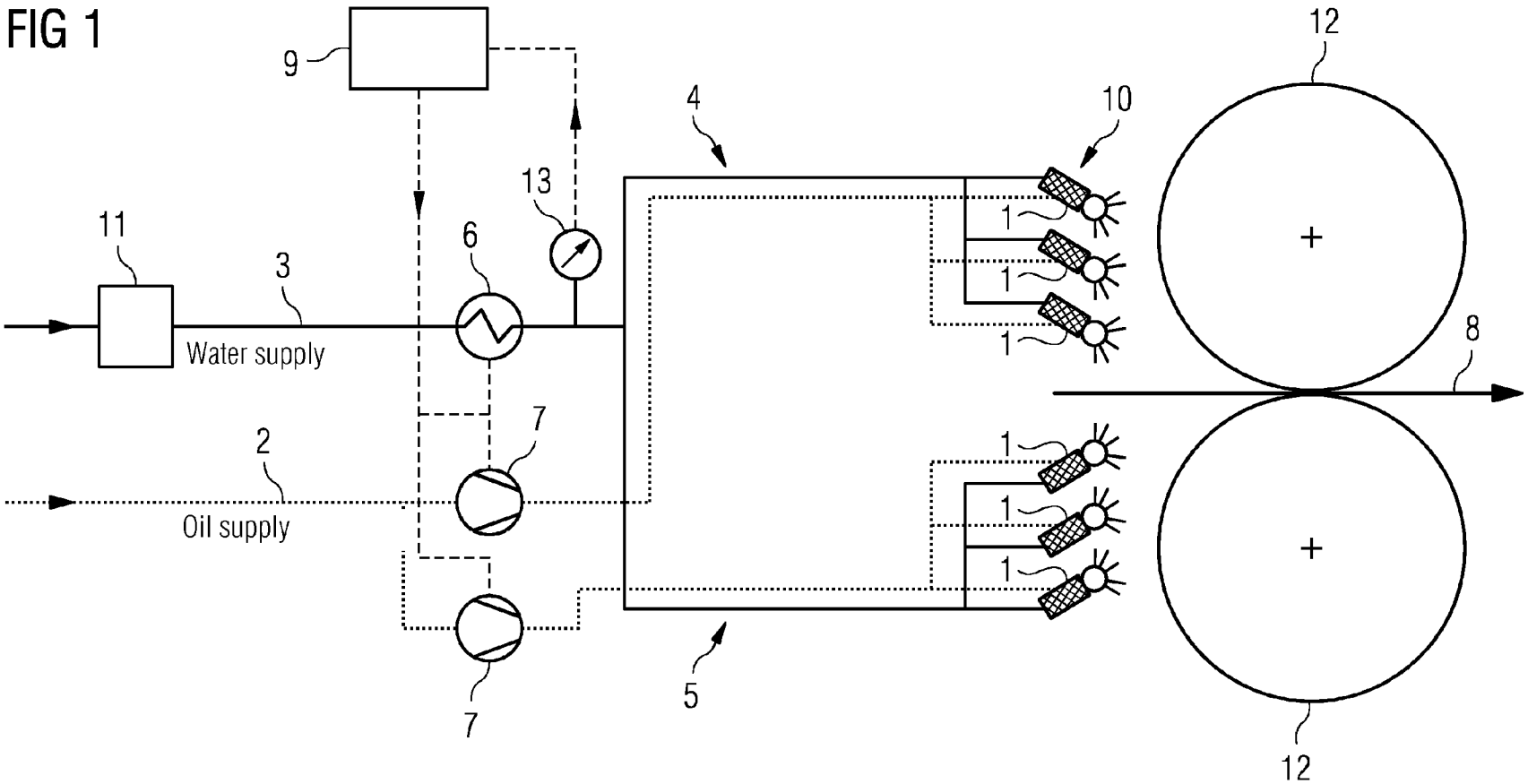
FIG. 1 a block diagram of a roll nip lubrication designed according to the invention.

FIG. 1 shows a diagrammatic view of an exemplary embodiment of the device according to the invention for lubricating the cylinders of a roll stand. For the sake of clarity, only the two cylinders 12 of the roll stand are shown, in the roll nip through which the roll band 8 is rolled. On the inlet side of the cylinders 12, a mixing and spraying device 10 can be seen. This mixing and spraying device 10 is comprised of a number of nozzle-mixer-units 1, each of which is supplied with oil and water. The dispersion is a water-oil mixture, comprised of extremely small oil droplets in water. On the one hand, each of these nozzle-mixer-units 1 operates as a mixer which processes oil and water to form a homogenous emulsion/dispersion. On the other hand, each of these nozzle-mixer-units 1 operates as a spraying unit which introduces the emulsion into the roll nip in the form of a spray. This introduction can take place by spraying in the direction of the roll gap, or in the direction of the cylinders and/or in the direction of the facing surface of the roll band.

In the exemplary arrangement of FIG. 1, three nozzle-mixer-units 1 are located on the upper side of the roll band 8 and three are located on the underside of the roll band 8. The upper arrangement of the nozzle-mixer-units 1 is supplied by an upper supply branch 4. The lower arrangement is supplied by a lower supply branch 5. Each arrangement is supplied with both oil and water. For this purpose, supply branches 4, 5 are fed with water by a first supply line 3 and with oil by a second supply line 2.

A heating device 6 is permanently installed in the first supply line 3 (the water supply), by means of which the water flowing from a source not identified in more detail to the mixing and spraying device 10 can be heated for the purposes of cleaning. This heating device 6 is for example an instantaneous water heater which has several heating elements in the form of electric resistance heating elements. The method of construction and installation of an instantaneous water heater can be assumed to be known here. As indicated by the dashed line in FIG. 1, the energy supply to the heating elements of the instantaneous water heater is controlled electronically by a microcomputer.

The second supply line 2 (supply) supplies the mixing and spraying device 10 with oil. It is likewise split into an upper supply branch 4 and a lower supply branch 5. A respective dosing pump 7 is connected in each of these branches 4, 5. Each of these dosing pumps 7 is controlled by the control unit 9 in such a way that the amount of the oil feed can be predetermined separately in the upper branch 4 and in the lower branch 5.

As aforementioned, the mixing and spraying device 10 comprises several nozzle-mixer-units 1. These nozzle-mixer-units 1 are each a structural unit. In other words, seen in the direction of flow, a respective mixer and spraying unit are locally arranged, with one directly behind the other. By mixing oil and water in an integrated structural unit, the dwell time for the emulsion/dispersion in this structural unit is very short. The cleaning process is comparatively simple as less saponification takes place.

The time at which a cleaning phase starts, as well as the duration of a rinsing procedure, is predetermined by the control unit 9. The control unit 9 takes into account the measurement signal of a sensor 13 in the water supply line 3 for this purpose. The measurement signal supplied by the sensor 13 reflects the level of contamination of the mixing and spraying device 10. In the present example, the sensor 13 is a pressure sensor. FIG. 1 shows this pressure sensor 13 downstream of the instantaneous water heater 6. Likewise, such a pressure sensor could also be arranged in the upper branch 4 or in the lower branch 5 of the water supply.

During the cleaning phase, the instantaneous water heater 6 heats the circulating water to a temperature of more than 60° Celsius. In a manner known per se, the energy supply to the heating elements of the instantaneous water heater 6 is predetermined in such a way that a predetermined water temperature can be maintained.

During a cleaning phase the dosing pumps 7 are inactive, resulting in the oil supply to the nozzle-mixer-units 1 being interrupted. The hot water flowing to the individual nozzle-mixer-units 1 cleans these and removes any existing saponification and deposition. The hot water necessary for cleaning is generated virtually online in the water supply line and does not originate from a reservoir.

In FIG. 1 a water treatment plant 11 is installed upstream of the instantaneous water heater 6. This water treatment plant 11 is an ion exchanger which removes lime and salts from the water and thus softens the water, as a result of which the heating elements of the instantaneous water heater 6 are less prone to calcification.

In contrast to the prior art, where a mixer supplies a number of spray nozzles and the distance between the mixer and the spray nozzles usually involves a length of pipe of more than one meter, the dwell time of the emulsion in the device according to the invention is far shorter. The extent of saponification is less with the mixing procedure and the spraying procedure taking place in one structural unit. If deposits are formed in the mixer or nozzle nevertheless, these can be removed with greater ease and the surface on which deposits may form is comparatively small as a result of the integrated construction. This leads to shorter maintenance intervals and consequently enables the availability of a rolling mill to be increased.

Figure 2:
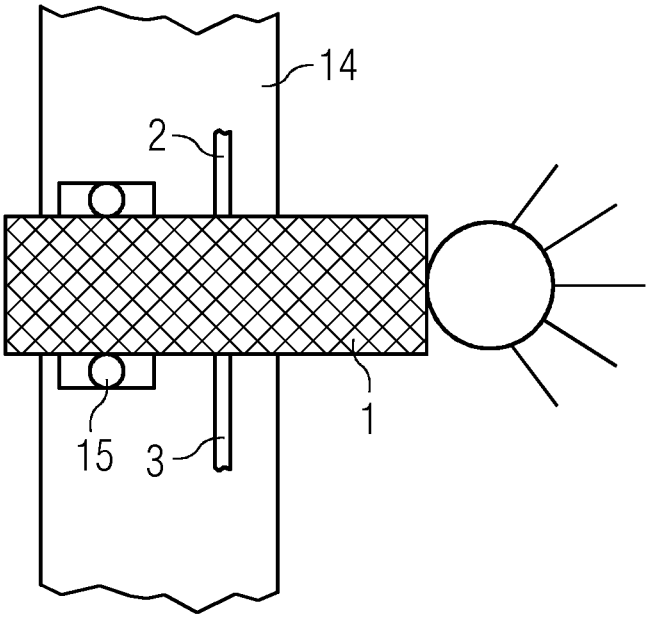
FIG. 2 a nozzle-mixer-unit which is fastened in a fixture by means of a quick release fastener.

Schematic diagram FIG. 2 shows the possible fastening of a nozzle-mixer-unit 1 by means of a snap-lock connection, e.g. a bayonet fastening 15 in a fixture device 14. During maintenance downtime, a nozzle-mixer-unit 1 can be released from the fixture device 14 very quickly by such a quick release fastener. The contaminated unit 1 can then be cleaned or maintained.

A major advantage of the device according to the invention is firstly the simpler opportunity for cleaning which is possible without chemical cleaning agents and acids, obviating the need for cleaning agents and acids as consumables.

Although the invention was illustrated and described in greater detail by the preferred exemplary embodiment, the invention is not restricted by the disclosed examples and the person skilled in the art can derive other versions therefrom without departing from the scope of protection of the invention. Thus, it is conceivable that instead of the aforementioned individual instantaneous water heater, a number of instantaneous water heaters are used. It is further conceivable that each nozzle-mixer-unit is assigned its own instantaneous water heater with a lower connected load.

COMPOSITION OF THE REFERENCE CHARACTERS USED

1 Mixer-nozzle-unit
2 Supply line for oil
3 Supply line for water
4 Upper supply branch
5 Lower supply branch
6 Inline heating device
7 Dosing pump for oil
8 Roll band
9 Control device
10 Mixing and spraying device
11 Water treatment plant
12 Cylinder
13 Sensors
14 Fixture device
15 Snap-lock connection

The invention claimed is:

1. A method for lubricating cylinders of a roll stand, for roll nip lubrication in the roll stand for a roll band, comprising:

producing a mixture of water and an oil by a mixing and spraying device, the producing comprising supplying water through a first supply line extending from a water source to the mixing and spraying device, and supplying the oil by a second supply line to the mixing and spraying device, the first supply line including a heating device installed to receive water from the water source and to supply heated water to the mixing and spraying device;

spraying the mixture onto a strip of the roll band and/or into a roll nip between the cylinders of the roll stand and/or onto at least one of the cylinders of the roll stand;

interrupting the supply of oil for a period of time of a cleaning phase which is predetermined by a control unit, and during the cleaning phase, heating the water flowing from the water source to the mixing and spraying device through the first supply line to more than 60° C. by the heating device installed in the first supply line to obtain hot water; and supplying the heated water to the mixing and spraying device from the heating device without storing the heated water in a reservoir, wherein the mixing and spraying device includes at least one structural unit, which is a single structural unit, that receives water from the first supply line and receives the oil from the second supply line, wherein the at least one structural unit is a nozzle-mixer-unit, and wherein the nozzle-mixer-unit is an integrated structural unit configured to mix the water and the oil and to spray the mixture.

2. The method as claimed in claim 1, further comprising flowing the hot water through the mixing and spraying device and/or a nozzle of the device.

3. The method as claimed in claim 1, further comprising heating the water with an electric instantaneous water heater used as the heating device, and controlling energy consumption of the heating device by the control unit.

4. The method as claimed in claim 2, further comprising a sensor recording a signal representing the flow and/or the pressure and/or the temperature in the first supply line; and supplying the recorded signal to the control unit and the control unit controlling the heating device based on the recorded signal.

5. The method as claimed in claim 3, further comprising controlling by the control unit the heating device for heating the water flowing to the mixing and spraying device to a predeterminable temperature value of more than 60° C. and adjusting the water temperature to 60° C.

6. The method as claimed in claim 1, further comprising preparing the water flowing to the mixing and spraying device by a water treatment plant arranged upstream of the heating device.

7. The method as claimed in claim 6, further comprising softening the water and/or removing undesired salts from the water in the water treatment plant.

8. The method as claimed in claim 1, wherein the mixing and spraying device comprises an arrangement of nozzle-mixer-units, the method further comprising supplying water and oil to each nozzle-mixer-unit.

9. The method as claimed in claim 8, wherein a number of the nozzle-mixer-units in the vicinity of the roll nip are each arranged on one of an upper side or an underside of the roll band on the inlet side to the roll nip.

10. The method as claimed in claim 9, further comprising separately predetermining each supply of oil for the nozzle-mixer-units on the upper side and on the underside of the roll band by a dosing pump.

11. A device for lubricating cylinders of a roll stand for providing roll nip lubrication in the roll stand for a roll band, comprising:

a mixing and spraying device;

a first supply line for supplying water extending from a water source to the mixing and spraying device and a second supply line for supplying oil to the mixing and spraying device for producing a mixture of water and oil, the mixing and spraying device spraying the mixture into the roll nip and/or onto at least one of the cylinders of the roll stand, and the first supply line including a heating device installed to receive water from the water source and to supply heated water to the mixing and spraying device without storing the heated water in a reservoir;

a control unit configured and operable for causing the mixing and spraying device to interrupt the supply of oil during a predetermined period of time of a cleaning phase; and the heating device is installed in the first supply line, configured for heating the water flowing to the mixing and spraying device to more than 60° C. during the cleaning phase, wherein the mixing and spraying device includes at least one structural unit, which is a single structural unit, that receives water from the first supply line and receives oil from the second supply line, wherein the at least one structural unit is a nozzle-mixer-unit, and wherein the nozzle-mixer-unit is an integrated structural unit configured to mix the water and the oil and to spray the mixture.

12. The device as claimed in claim 11, further comprising the heating device comprising an electric, oil or gas-powered instantaneous water heater configured for controlling energy consumption which can be controlled, and the control unit being configured and operable for controlling the heating device.

13. The device as claimed in claim 11, further comprising a sensor arranged in the first supply line, for sensing a parameter in the first supply line, the sensor emitting a measurement signal and supplying the signal to the control unit.

14. The device as claimed in claim 13, wherein the sensor comprises a pressure sensor, a flow sensor and/or a temperature sensor.

15. The device as claimed in claim 12, wherein the control unit is configured for controlling the heating device such that the water flowing to the mixing and spraying device is heated to a predefinable temperature value of more than 60° C. and is adjusted to this value.

16. The device as claimed in claim 12, further comprising a water treatment plant arranged upstream of the heating device, configured for setting a degree of hardness or a salt content of the water flowing to the mixing and spraying device.

17. The device as claimed in claim 11, wherein the mixing and spraying device is formed of an arrangement of nozzle-mixer-units, and oil and water are supplied to each nozzle-mixer unit individually and to an individual extent.

18. The device as claimed in claim 17, wherein each nozzle-mixer-unit is a structural unit.

19. The device as claimed in claim 17, further comprising a number of the nozzle-mixer-units in the vicinity of the roll nip are arranged respectively at an upper side or at an underside of the roll band.

20. The device as claimed in claim 17, further comprising a respective fixture comprising a snap-lock connection for holding each nozzle-mixer-unit in the respective fixture.

* * * * *